US006939248B2

(12) United States Patent
Naruo et al.

(10) Patent No.: US 6,939,248 B2
(45) Date of Patent: Sep. 6, 2005

(54) WOOD GOLF CLUB HEAD DESIGNED TO DESCRIBE THE OPTIMUM TRAJECTORY OF A GOLF BALL

(75) Inventors: Takeshi Naruo, Osaka (JP); Yoshihiro Fujikawa, Kaizuka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/613,473

(22) Filed: Jul. 2, 2003

(65) Prior Publication Data

US 2004/0033845 A1 Feb. 19, 2004

(30) Foreign Application Priority Data

Jul. 4, 2002 (JP) ..... 2002-195603

(51) Int. Cl.[7] ..... A63B 53/04

(52) U.S. Cl. ..... 473/324; 473/329; 473/330; 473/332; 473/345; 473/349; 473/409

(58) Field of Search ..... 473/409, 324–350

(56) References Cited

U.S. PATENT DOCUMENTS

| | | | | | |
|---|---|---|---|---|---|
| 3,625,518 | A | * | 12/1971 | Solheim | 473/330 |
| 4,730,830 | A | * | 3/1988 | Tilley | 473/337 |
| 4,951,953 | A | * | 8/1990 | Kim | 473/320 |
| 5,076,585 | A | * | 12/1991 | Bouquet | 473/343 |
| 5,141,231 | A | * | 8/1992 | Cox | 473/330 |
| 5,366,223 | A | * | 11/1994 | Werner et al. | 473/349 |
| 5,377,986 | A | * | 1/1995 | Viollaz et al. | 473/330 |
| 5,405,136 | A | * | 4/1995 | Hardman | 473/342 |
| 5,423,535 | A | * | 6/1995 | Shaw et al. | 473/291 |
| 5,489,098 | A | * | 2/1996 | Gojny et al. | 473/342 |
| 5,674,132 | A | * | 10/1997 | Fisher | 473/290 |
| 5,743,812 | A | * | 4/1998 | Card | 473/327 |
| 6,193,614 | B1 | * | 2/2001 | Sasamoto et al. | 473/329 |
| 6,309,310 | B1 | * | 10/2001 | Shira | 473/331 |
| 6,368,234 | B1 | * | 4/2002 | Galloway | 473/349 |
| 6,402,636 | B1 | | 6/2002 | Chang | |
| 6,428,427 | B1 | | 8/2002 | Kosmatka | |
| 6,478,693 | B2 | * | 11/2002 | Matsunaga et al. | 473/345 |
| 6,695,712 | B1 | * | 2/2004 | Iwata et al. | 473/291 |
| 2002/0004426 | A1 | | 1/2002 | Lin et al. | |

FOREIGN PATENT DOCUMENTS

| | | |
|---|---|---|
| WO | WO 02/28490 A1 | 4/2002 |

* cited by examiner

*Primary Examiner*—Sebastiano Passaniti
(74) *Attorney, Agent, or Firm*—W. F. Fasse; W. G. Fasse

(57) ABSTRACT

A wood golf club head is adapted to achieve the maximum flight distance or optimum trajectory of a golf ball, by incorporating features to achieve an appropriate correlation between launch angle and backspin speed of a golf ball that is struck by the club head. A wood golf club head is designed to achieve a launch angle and a backspin speed of a golf ball located in an angle-spinspeed region defined by an ellipse having a center point O(21, 1800), length of a major axis L equal to 2100(rpm), length of a minor axis S equal to 5.7(deg), and tilt angle θ of the major axis measured in a counterclockwise direction from the vertical axis equal to 0.25(deg), wherein the horizontal coordinate designates the launch angle(deg) of the golf ball, the vertical coordinate designates the backspin speed(rpm) of the golf ball, and the horizontal and vertical axes have the same numerical scale. Preferably, the wood golf club head has a face formed of a low friction material and a loft angle of 13 to 20 degrees.

17 Claims, 6 Drawing Sheets

WOOD GOLF CLUB HEAD DESIGNED TO DESCRIBE THE OPTIMUM TRAJECTORY OF A GOLF BALL

BACKGROUND OF THE INVENTION

The present invention relates to a wood golf club head, and more particularly, to a wood golf club head which can describe the most desirable trajectory of a golf ball, that is, which can achieve the maximum flight distance of a golf ball effectively.

Conventionally, in relation to a wood golf club head, especially a driver club head, various kinds of efforts have been made to improve the flight distance of a golf ball struck by such a club head. Experience has shown that a launch angle and a backspin speed of a golf ball after striking it as well as the head speed of the golf club being used should be appropriately determined in order to increase the flight distance of the ball.

For example, as to the correlation between the head speed of a golf club and the launch angle of a golf ball, it has been considered preferable that inverse correlation exists between them. That is, as the club head speed becomes higher the ball launch angle is made smaller, whereas as the club head speed becomes lower the ball launch angle is made greater.

Also, as to the correlation between the club head speed and the backspin, a certain range of the most desirable backspin relative to the club head speed has been determined according to the rule of the thumb. For example, as the club head speed becomes higher the backspin rate is made lower, whereas as the club head speed becomes lower the backspin rate is made higher.

However, there have been no formulations to describe the correlation between the club head speed, ball launch angle and backspin rate, especially the correlation between the ball launch angle and backspin rate in order to improve the ball flight distance more effectively.

The present invention has been made in view of these circumstances, and its object is to provide a wood golf club head which can effectively achieve the maximum flight distance of a golf ball, that is, which can describe the optimum trajectory or the flight path of a golf ball, by incorporating appropriate correlation between the launch angle and backspin speed of a golf ball immediately after ball impact.

SUMMARY OF THE INVENTION

Different kinds of trajectory computing methods of a golf ball have been developed so far, but the there were considerable errors between the ball flight distance calculated by the trajectory computing methods and the flight distance of a ball that has been actually struck and measured. Therefore, the trajectory computing methods of prior art are not accurately established.

The inventors of the present invention have been engaged in the trajectory computing method of a golf ball for a long period of time, and have now found that the ball flight distance determined by the following method coincides with the actual ball flight distance very precisely.

A ball that has been struck by a golf club head is influenced by aerodynamic force during flight. By forming the equation of motion under the influence of the aerodynamic force and solving it by numerical analysis, the ball position at every moment can be determined.

Now, force F applied to a ball in flight at time instant t can be expressed below when X coordinate designates the flight direction and Y coordinate the vertical direction.

$$F_X(t)=-\tfrac{1}{2}(C_D(t)\cos\alpha+C_L(t)\sin\alpha)\rho A V_B(t)^2 \quad (1)$$

$$F_Y(t)=-\tfrac{1}{2}(C_D(t)\sin\alpha-C_L(t)\cos\alpha)\rho A V_B(t)^2-mg \quad (2)$$

where $C_D$: drag coefficient, $C_L$: lift coefficient, $\alpha$: ball elevation angle(deg), $\rho$: air density(kg/m$^3$), A: ball sectional area(m$^2$), $V_B$: ball velocity(m/sec), m: ball mass(kg), g: gravitational acceleration(m/sec$^2$).

Also, the golf ball during flight is influenced by aerodynamic torque that decreases the rotational speed of the ball. Decrease in the rotational speed of the ball due to the aerodynamic torque can be expressed as follows:

$$N(t+\Delta t)=-\rho A d C_m(t) V_B(t)^2 \Delta t/(4\pi I)+N(t) \quad (3)$$

where $C_m$: moment coefficient, d: ball diameter(m), I: moment of inertia of a ball (kg·m$^2$), N: ball rotational speed(rps).

FIG. 5 shows that the calculated values of the flight distance of a golf ball, which have been obtained by solving the equation of motion using the above-mentioned equations (1), (2) and (3) under the same initial conditions as the ball impact, coincide very precisely with the actually measured values of the flight distance of a golf ball, which has been struck by a golf robot. That is, in FIG. 5, the calculated values and the measured values are located approximately along the graph, y=x, which means the both values nearly coincide with each other.

Incidentally, the flight distance of a golf ball that has been struck by the golf club head is determined by the initial velocity of the ball immediately after the impact, the launch angle of the ball, which is the angle the ball flight makes to the horizontal when it initially comes off the club face, and the rotational speed (or spin speed) of the ball immediately after the ball leaves the club face. The ball velocity is generally determined by the club head speed of a golfer and the restitution coefficient of the club head relative to the ball. Thereby, in the case of each individual golfer and club, correlation between the launch angle and backspin speed that makes the ball flight distance maximum can be achieved. To be concrete, at an arbitrary ball speed, with the variables of the launch angle and backspin speed, the optimal solution is sought using the above-mentioned equation of motion. The optimal solution shows the correlation between the launch angle and the backspin that makes the ball flight distance maximum.

The present invention has been made in view of these circumstances. The wood golf club head according to a first embodiment of the present invention is designed so that the launch angle and backspin speed of a golf ball can be located in the region defined by the ellipse, shown in FIG. 2, whose center is positioned on point O(21, 1800), length of a major axis L is equal to 2100(rpm), length of a minor axis S is equal to 5.7(deg), and gradient $\theta$ of the major axis measured in a counterclockwise direction from the vertical axis is equal to 0.25(deg), wherein the horizontal coordinate designates the launch angle(deg) of a golf ball, the vertical coordinate designates the backspin speed(rpm) of a golf ball, and the horizontal and vertical axes are on the same scale, i.e. have the same numerical scale and spacing.

FIG. 2 illustrates the correlation that the ball launch angle and backspin should satisfy irrespective of the ball speed, which is one of the initial parameters at the onset of ball launch. The region defined by this ellipse is determined to encompass the entire region of the maximum ball flight distance that is achieved at various ball speeds. That is, by designing a wood golf club head so that the ball launch angle and backspin can satisfy, at any ball speed, the correlation defined by the ellipse shown in FIG. 2, a wood golf club head that can describe the optimum trajectory of a golf ball is achieved.

Additionally, in FIG. 2, the scale of the horizontal axis is considerably (about 210 times) expanded relative to the scale of the vertical axis for illustration purposes. Consequently, in the case where the horizontal and vertical axes are on the same scale, or each interval of the both scales is equal to each other, the ellipse of FIG. 2 is raised along the vertical direction and becomes a very thin shape extended in the vertical direction. As a result, each parameter of the ellipse can be expressed as each afore-mentioned value. Also, as can be seen from the terms, major and minor axes of the ellipse, the length of the major axis L is twice the distance from the center O to the outermost edges on the ellipse along the major axis. Similarly, the length of the minor axis S is twice the distance from the center O to the outermost edges on the ellipse along the minor axis.

The wood golf club head according to a second preferred embodiment of the invention is designed so that the launch angle and backspin speed of a golf ball can be located in the region defined by the ellipse, shown in FIG. 3, whose center is positioned on point O(23, 1700), length of a major axis L is equal to 1900(rpm), length of a minor axis S is equal to 3.9(deg), and gradient θ of a major axis measured in a counterclockwise direction from the vertical axis is equal to 0.19(deg), wherein the horizontal coordinate designates the launch angle(deg) of a golf ball, the vertical coordinate designates the backspin speed(rpm) of a golf ball, and the horizontal and vertical axes are on the same scale, i.e. have the same numerical scale and spacing. Additionally, in FIG. 3 as well, the scale of the horizontal axis is considerably expanded relative to the scale of the vertical axis for the purpose of illustration.

The ellipse of FIG. 3 is included in the region defined by the ellipse shown in FIG. 2, but FIG. 3 shows the correlation that the ball launch angle and backspin speed should satisfy to achieve 99% of the maximum ball flight distance especially at the ball speed of 50m/s in the region of FIG. 2. The reason why the ball speed of 50 m/s is particularly selected here is that the wood golf club head according to the second embodiment is designed for an average golfer whose club head speed is somewhat slower.

In this case, by designing a wood golf club head in such a way that the ball launch angle and backspin speed can satisfy the correlation that is included in the region defined by the ellipse shown in FIG. 3, a wood golf club head can be achieved that can describe more preferable, or the optimum trajectory of a golf ball for an average golfer of somewhat slower club head speed.

The wood golf club head according to a third embodiment of the invention is designed so that the launch angle and backspin speed of a golf ball can be located in the region defined by the ellipse, shown in FIG. 4, whose center is positioned on point O(23, 1700), length of a major axis L is equal to 1400(rpm), length of a minor axis S is equal to 2.8(deg), and gradient θ of a major axis measured in a counterclockwise direction from the vertical axis is equal to 0.19(deg), wherein the horizontal coordinate designates the launch angle(deg) of a golf ball, the vertical coordinate designates the backspin speed(rpm) of a golf ball, and the horizontal and vertical axes are on the same scale, i.e. have the same numerical scale and spacing. Additionally, in FIG. 4 as well, the scale of the horizontal axis is considerably expanded relative to the scale of the vertical axis for the purpose of illustration.

The ellipse of FIG. 4 is also included in the region defined by the ellipse shown in FIG. 2, but FIG. 4 shows the correlation that the ball launch angle and backspin speed should satisfy to achieve 99.5% of the maximum ball flight distance especially at the ball speed of 50 m/s in the region of FIG. 2. The wood golf club head according to the third embodiment, as with the club head according to the second embodiment, is designed for an average golfer whose club head speed is somewhat slower.

In this case, by designing a wood golf club head in such a way that the ball launch angle and backspin speed can satisfy the correlation that is included in the region defined by the ellipse shown in FIG. 4, a wood golf club head can be achieved that can describe the most preferable, or the optimum trajectory of a golf ball for an average golfer of somewhat slower club head speed.

With respect to the wood golf club head according to a fourth aspect in connection with the first, second or third embodiment of the invention, the above-mentioned ellipse is determined by solving the equation of motion via numerical analysis using the following equations:

$$F_x(t)=-\tfrac{1}{2}(C_D(t)\cos\alpha+C_L(t)\sin\alpha)\,\rho A V_B(t)^2;$$

$$F_Y(t)=-\tfrac{1}{2}(C_D(t)\sin\alpha-C_L(t)\cos\alpha)\,\rho A V_B(t)^2-mg;$$

and $$N(t+\Delta t)=-\rho A d C_m(t) V_B(t)^2\,\Delta t/(4\pi I)+N(t);$$

where $F_X(t)$ is force applied to a ball in flight in the flight direction at time instant t, $F_Y(t)$ is force applied to a ball in flight in the vertical direction at time instant t, and $N(t+\Delta t)$ is decrease in the rotational speed of a ball due to aerodynamic torque after interval of Δt; and where $C_D$: drag coefficient, $C_L$: lift coefficient, α: elevation angle of a ball(deg), π: air density(kg/m$^3$), A: sectional area of a ball (m$^2$), $V_B$: ball velocity(m/sec), m: ball mass(kg), g: gravitational acceleration(m/sec$^2$), $C_m$: moment coefficient, d: ball diameter(m), I: moment of inertia of a ball (kg·m$^2$), N: ball rotational speed(rps).

With respect to the wood golf club head according to a fifth aspect in connection with the first, second or third embodiment of the invention, a face, or striking surface, of the wood golf club head is formed of a low friction material.

Here, FIG. 6 shows actually measured values of ball initial velocity, launch angle, and backspin speed of driver shots of a large number of golfers. In FIG. 6, the measured values of driver shots are plotted in dots, but so-called mis-shots are included in these dots. In addition, the ellipse in FIG. 6 is the same as that in FIG. 2. As can be seen in FIG. 6, all of the actually measured values of the driver shots are not included in the elliptical region for achieving the longest ball flight distance that has been obtained by the above-mentioned trajectory simulation. Generally, the measured values are located to the left hand of the ideal elliptical region. Therefore, in the measured values, backspin speeds are approximately proper, but the launch angles are lower.

In order to increase the ball launch angle, increasing loft of a club head may be considered one way. However, merely increasing the loft makes the spin speed as well enlarged. Thereby, each of the dots plotted in FIG. 6 is transferred to the upper right of the ellipse. As a result, a golf ball struck by the club head cannot describe the optimum trajectory and the golf ball carry cannot be improved.

Therefore, in order to put these dots inside and near the ellipse, it is necessary to enlarge only the launch angle without increasing the backspin speed. For that reason, some measures to increase the loft as well as to decrease the backspin speed are required. As an example, a low friction material may be utilized on the face of the golf club head so as to decrease the coefficient of friction of the face relative to the ball. Alternatively, a coating layer may be formed on the face. The invention according to a fifth aspect has been made in view of these standpoints.

In this case, by decreasing the coefficient of the face, backspin of the ball after impact can be reduced. As shown in each of the elliptic regions in FIGS. 2 to 4, the area of the elliptic region under the backspin of e.g. 2000 rpm is wider than that of the elliptic region over the backspin of 2000 rpm. Thereby, controlling the backspin rate at a lower level makes it easy to put the correlation between the ball launch angle and backspin speed inside the elliptic regions.

Techniques to decrease the coefficient of friction of the face are, as described according to a sixth aspect of the invention, any one of the coatings such as DLC(Diamond-like carbon) film coating, ceramic coating, and SiC coating. In these coating layers, especially, the DLC coating layer having a coefficient of friction of 0.1 or less, which is lower relative to the metal nitride film or the like, is more preferable. Also, the DLC coating layer has a higher hardness and thus, a superior wear resistance. The ceramic coating can achieve an ultra-low coefficient of friction by doping TEFLON® (tetrafluoroethylene fluorocarbon polymer or fluorinated ethylene-propylene polymer; DuPont) into the minute pores of the ceramic film. The SiC coating has a higher hardness and thus, it is superior in wear resistance.

Also, as described according to a seventh aspect of invention, DYNEEMA® FRP (DFRP: Ultra-High-Strength Polyethylene Fiber Reinforced Plastic; TOYOBO Co., Ltd.) may be used as a face material. In this case, the coefficient of friction of the face can be reduced and besides, the strength of the face can be improved.

Moreover, as described according to an eighth aspect of the invention, chromium plating or dispersed nickel plating may be utilized on the face to decrease the coefficient of friction of the face.

Alternatively, as described according to a ninth aspect of the invention, the face may have an insert formed of polyacetal (POM), polyamide (PA), polytetrafluoroethylene (PTFE), polyphenylenesulfide (PPS), polyamideimide (PAI), or polyimide (PI).

In these materials, particularly, polytetrafluoroethylene (PTFE) has a remarkably lower coefficient of friction and higher wear resistance, and thus, it is more preferable as a face material.

Also, as described according to a tenth aspect of the invention, the face of a wood golf club head may be formed of composite materials that are made from pitch-based carbon fiber and a pitch-based matrix. Since such composite materials are superior in wear resistance, they are preferable as a face material.

According to an eleventh aspect in connection with the first, second or third embodiment, and/or the fourth aspect of the invention, the wood golf club head may be a driver club head.

According to a twelfth aspect in connection with the first, second or third embodiment, and/or the fourth aspect of the invention, the wood golf club head may be a driver club head whose loft (i.e. loft angle) is 13 to 20 degrees.

Incidentally, the loft angle for a men's driver club of the prior art is generally 8 to 12 degrees. However, such a loft angle cannot achieve an adequate ball launch angle. Therefore, in order to obtain the maximum golf ball carry as in the present invention, a driver with a loft angle of 13 to 20 degrees is preferable. The degree of loft angle less than 13 degrees has difficulty in achieving a ball launch angle of 13 degrees or more. As a result, it becomes difficult to impact a golf ball within the elliptic regions described according to the first, second and third embodiments of the invention. Also, the degree of loft angle more than 20 degrees decreases the restitution ratio, or the ratio of the initial ball velocity relative to the club head speed. Thereby, the ball speed becomes lower, and thus, the golf ball carry will not be improved.

According to the eleventh and twelfth aspects of the invention, a driver club head, which requires the greatest ball flight distance among wood golf club heads, can describe the optimum trajectory of a golf ball.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
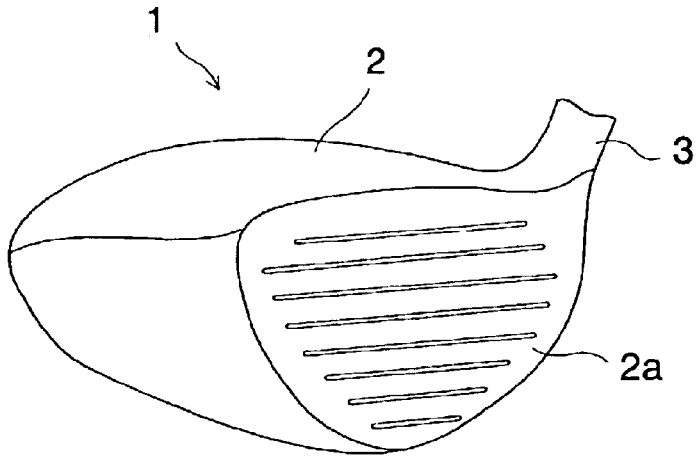
FIG. 1 is a perspective view of a driver club head of the present invention.

A wood golf club head according to the present invention is shown in FIG. 1. Here, a driver club head is shown by way of example.

As shown FIG. 1, a driver club head 1 is composed of a head body 2 and a neck portion 3 that are integrally formed with each other. A face (or ball striking face) 2*a* of the head body 2 is formed of material of a low coefficient of friction.

To be concrete, the face 2*a* is coated with DLC(Diamond-like Carbon) coating. DLC is a thin carbon film formed by a vapor phase synthetic method using hydrocarbon or solid carbon as a raw material. Since the DLC film has a lower coefficient of friction of 0.1 or less and a superior wear resistance, it is more preferable as the face material of a driver club head.

Also, the face 2*a* may be coated with ceramic or SiC. The ceramic coating can achieve an ultra-low coefficient of friction by doping TEFLON® (tetrafluoroethylene fluorocarbon polymer or fluorinated ethylene-propylene polymer; DuPont) into the minute pores of the ceramic film. The SiC coating has a higher hardness and a superior wear resistance. Moreover, the face 2*a* may be composed of DYNEEMA® FRP (DFRP: Ultra-High-Strength Polyethylene Fiber Reinforced Plastic). In this case, the coefficient of friction of the face 2*a* can be reduced and besides, strength of the face 2*a* can be improved. Furthermore, the face 2*a* may be plated with chromium or dispersed nickel to reduce the coefficient of friction thereof.

Alternatively, the face 2*a* may be provided with an insert formed of polytetrafluoroethylene(PTFE). The PTFE has a remarkably lower coefficient of friction and higher wear resistance, and thus, it is more preferable as a face material of a driver club head. In addition, the insert may be formed of polyacetal (POM), polyamide (PA), polyphenylenesulfide (PPS), polyamideimide(PAI), or polyimide(PI).

Also, the face 2*a* may be formed of composite materials that are made from pitch-based carbon fiber and pitch-based matrix. Since such composite materials are superior in wear resistance, they are preferable as a face material.

In such a manner, by composing the club head face 2*a* from material with a lower coefficient of friction, backspin is hard to occur on a golf ball after impact. Thereby, backspin after impact can be controlled at e.g. 2000 (rpm) or less. As a result, the launch angle and backspin of a golf ball immediately after leaving the club head face can be easily located in each of the elliptic regions that are shown in FIGS. 2 to 4.

Figure 2:
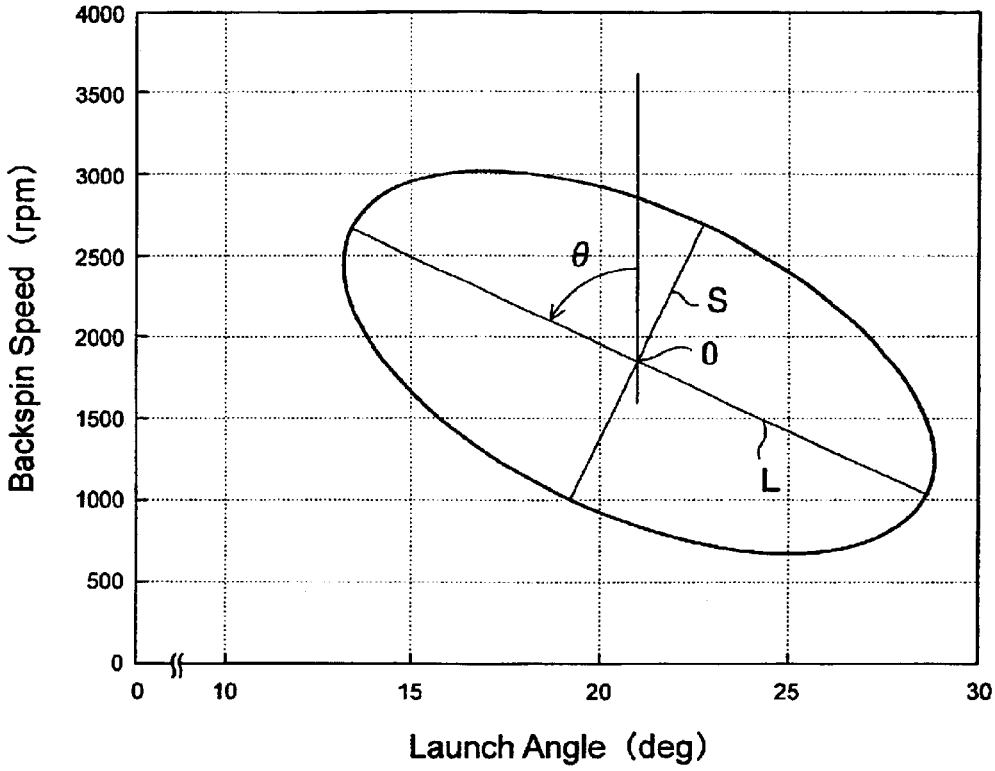
FIG. 2 is a graph illustrating the correlation between the ball launch angle and backspin speed according to a wood golf club head of a first embodiment of the present invention.
Figure 3:
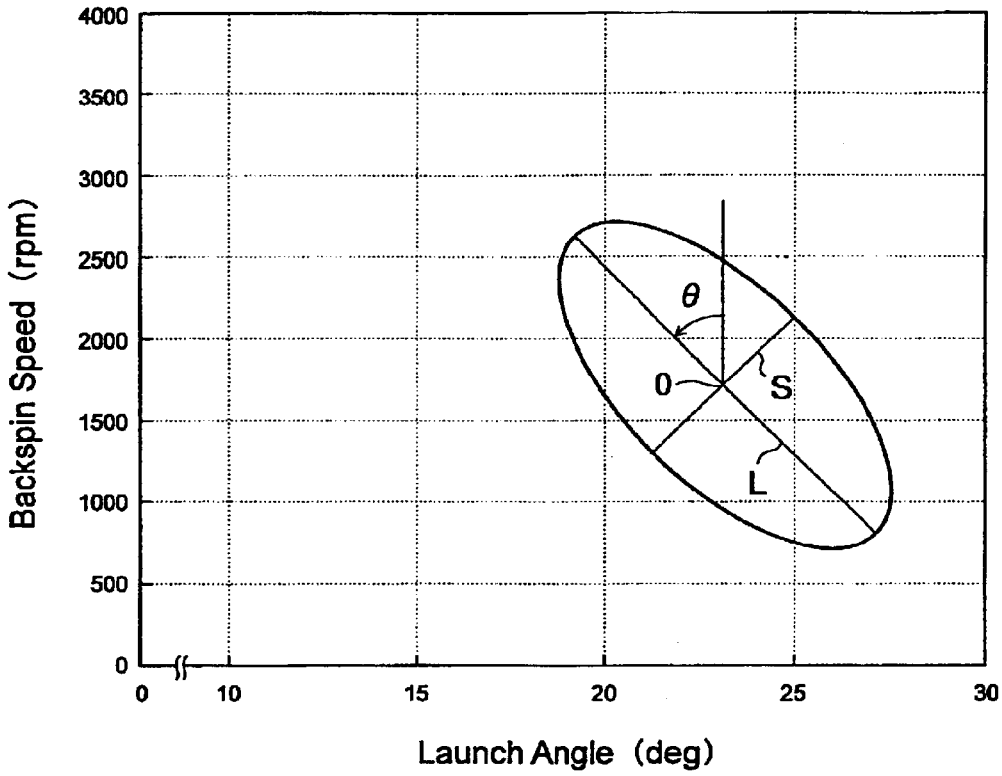
FIG. 3 is a graph illustrating the correlation between the ball launch angle and backspin speed according to a wood golf club head of a second embodiment of the present invention.
Figure 4:
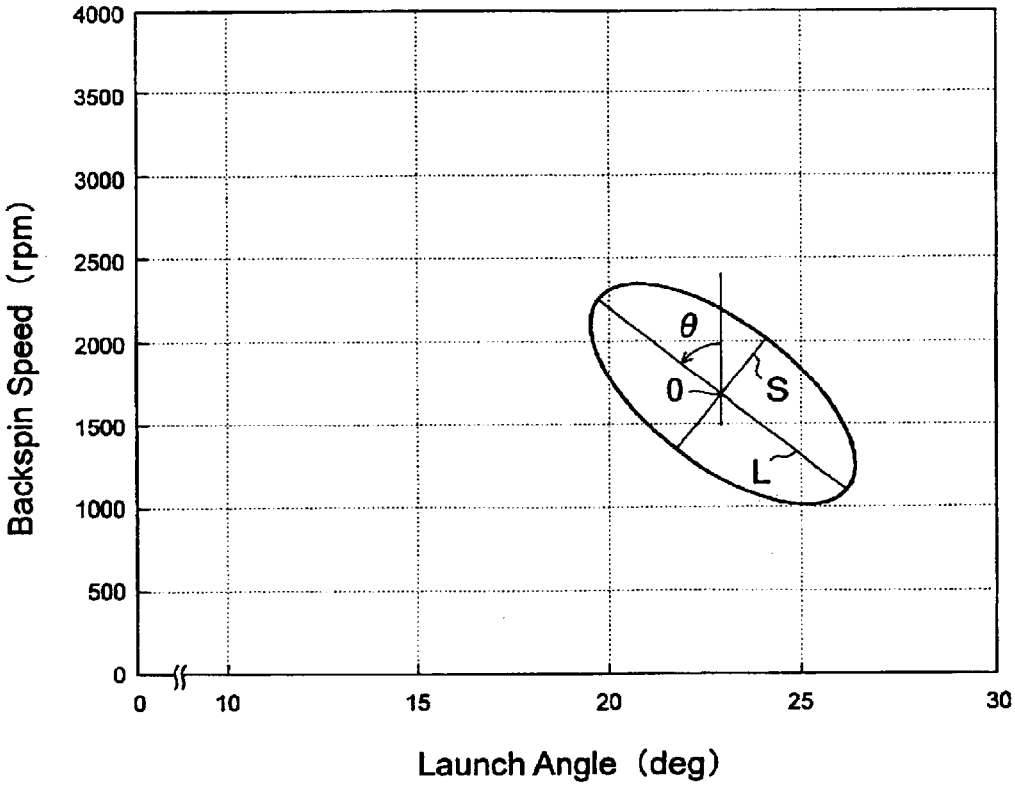
FIG. 4 is a graph illustrating the correlation between the ball launch angle and backspin speed according to a wood golf club head of a third embodiment of the present invention.
Figure 5:
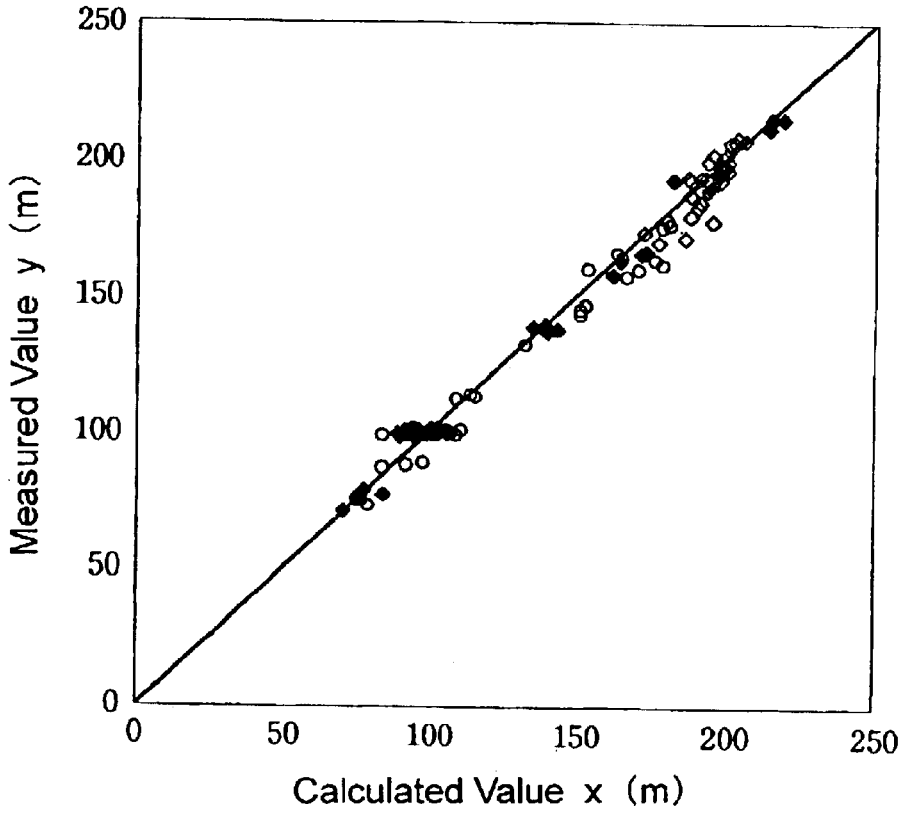
FIG. 5 is a graph illustrating the correlation between the measured value of ball flight distance and the calculated value of ball flight distance under the same initial condition according to the trajectory computing method of the present invention.
Figure 6:
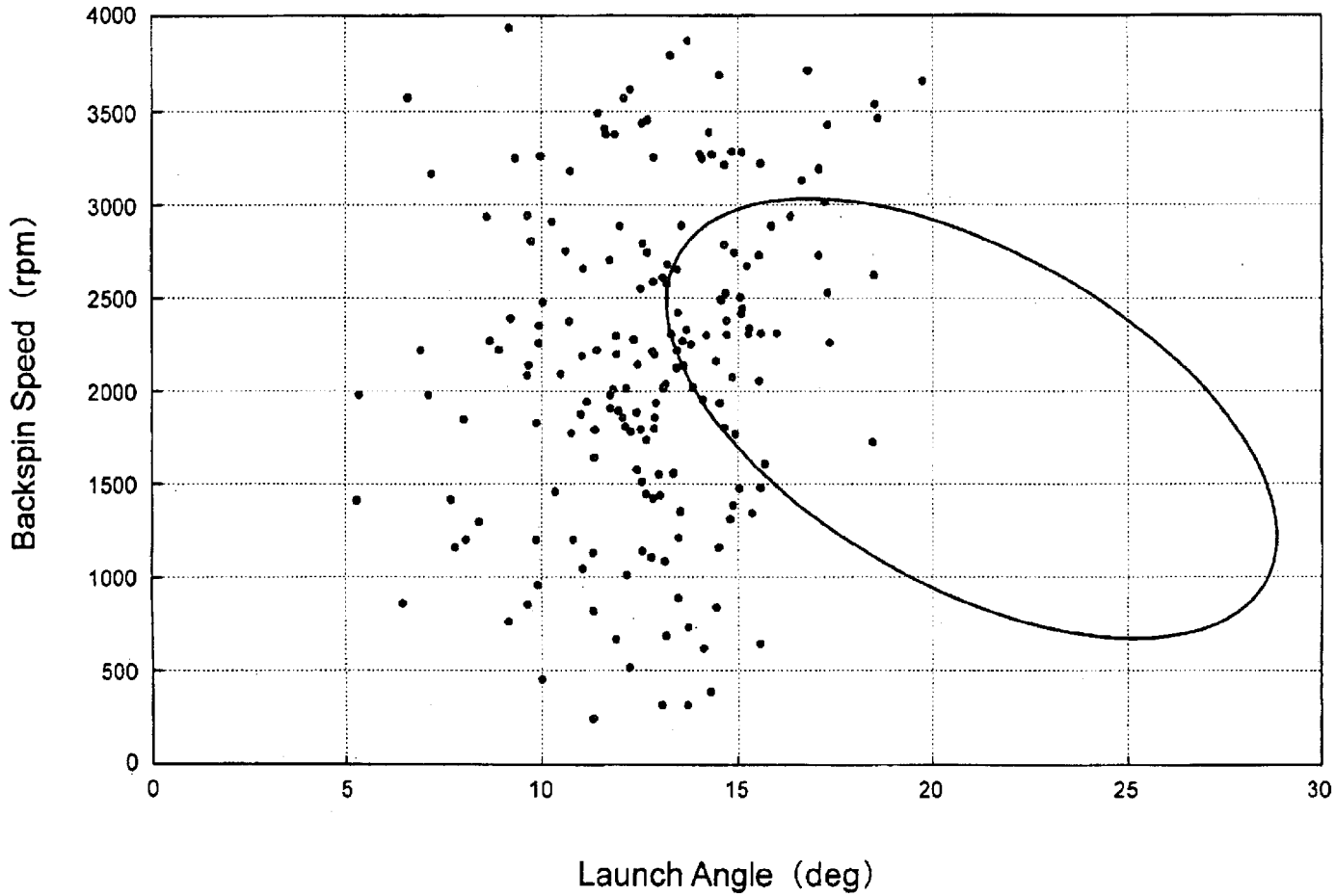
FIG. 6 is a schematic illustrating measured values of driver shots along with ellipse shown in FIG. 2.

Here, each of the elliptic regions, or regions encompassed by the ellipses shown in FIGS. 2 to 4, illustrates correlation that the launch angle and back spin speed of a golf ball after impact should satisfy to achieve the longest ball flight distance.

FIG. 2 illustrates the correlation that the ball launch angle and backspin should satisfy irrespective of the ball speed, which is one of the initial parameter at the onset of the ball launch. The region defined by this ellipse is determined to encompass the entire region of the maximum ball flight distance that is achieved at various ball speeds. That is, by designing a wood golf club head so that the ball launch angle and backspin can satisfy, at any ball speed, the correlation defined by the ellipse shown in FIG. 2, the wood golf club head that can effectively obtain the maximum ball carry or describe the optimum trajectory of a golf ball is achieved.

The ellipse of FIG. 3 is included in the region defined by the ellipse shown in FIG. 2, but FIG. 3 shows the correlation that the ball launch angle and backspin speed should satisfy to achieve 99% of the maximum ball flight distance especially at the ball speed of 50 m/s in the elliptic region of FIG. 2. The reason why the ball speed of 50 m/s is particularly selected here is that the wood golf club head shown in FIG. 3 is especially designed for an average golfer whose club head speed is somewhat slower.

In this case, by designing a wood golf club head in such a way that the ball launch angle and backspin speed can satisfy the correlation that is included in the region defined by the ellipse shown in FIG. 3, a wood golf club head can be achieved that can describe more preferable, or the optimum trajectory of a golf ball for an average golfer of somewhat slower club head speed.

The ellipse of FIG. 4 is also included in the region defined by the ellipse shown in FIG. 2, but FIG. 4 shows the correlation that the ball launch angle and backspin speed should satisfy to achieve 99.5% of the maximum ball flight distance especially at the ball speed of 50 m/s in the region of FIG. 2. The wood golf club head shown in FIG. 4, as with the club head in FIG. 3, is especially designed for an average golfer whose club head speed is somewhat slower.

In this case, by designing a wood golf club head in such a way that the ball launch angle and backspin speed can satisfy the correlation that is included in the region defined by the ellipse shown in FIG. 4, a wood golf club head can be achieved that can describe the most preferable, or the optimum trajectory of a golf ball for an average golfer of somewhat slower club head speed.

Each of the ellipses in FIGS. 2 to 4 is determined by solving the equation of motion via numerical analysis using the following equations:

$$F_X(t)=-\tfrac{1}{2}(C_D(t)\cos\alpha+C_L(t)\sin\alpha)\rho A V_B(t)^2;$$

$$F_Y(t)=-\tfrac{1}{2}(C_D(t)\sin\alpha-C_L(t)\cos\alpha)\rho A V_B(t)^2-mg;\text{ and}$$

$$N(t+\Delta t)=-\rho A d C_m(t) V_B(t)^2\Delta t/(4\pi I)+N(t);$$

where $F_X(t)$ is force applied to a ball in flight in the flight direction at time instant t, $F_Y(t)$ is force applied to a ball in flight in the vertical direction at time instant t, and $N(t+\Delta t)$is decrease in the rotational speed of a ball due to aerodynamic torque after interval of $\Delta t$; and where $C_D$: drag coefficient, $C_L$: lift coefficient, $\alpha$: elevation angle of a ball (deg), $\rho$: air density(kg/m$^3$), A: ball sectional area(m$^2$), $V_B$: ball velocity (m/sec), m: ball mass(kg), g: gravitational acceleration(m/sec$^2$), $C_m$: moment coefficient, d: ball diameter(m), I: moment of inertia of a ball (kg·m$^2$), N: ball rotational speed(rps).

FIG. 2 shows an ellipse whose center is positioned on Point O(21, 1800), length of a major axis L is equal to 2100(rpm), length of a minor axis S is equal to 5.7(deg), and gradient $\theta$ of a major axis measured in a counterclockwise direction from the vertical axis is equal to 0.25(deg), wherein the horizontal and vertical axes are on the same scale.

FIG. 3 shows an ellipse whose center is positioned on Point O(23, 1700), length of a major axis L is equal to 1900(rpm), length of a minor axis S is equal to 3.9(deg), and gradient $\theta$ of a major axis measured in a counterclockwise direction from the vertical axis is equal to 0.19(deg), wherein the horizontal and vertical axes are on the same scale.

FIG. 4 shows an ellipse whose center is positioned on Point O(23, 1700), length of a major axis L is equal to 1400(rpm), length of a minor axis S is equal to 2.8(deg), and gradient $\theta$ of a major axis measured in a counterclockwise direction from the vertical axis is equal to 0.19(deg), wherein the horizontal and vertical axes are on the same scale.

Additionally, in FIGS. 2 to 4, the scale of the horizontal axis is considerably expanded relative to the scale of the vertical axis for illustration purposes. Consequently, in the case where the horizontal and vertical axes are on the same scale, or each interval of the both scales is equal to each other, each of the ellipses of FIGS. 2 to 4 is raised along the vertical direction and becomes a very thin shape extended in the vertical direction. As a result, each parameter of the ellipse can be expressed as each afore-mentioned value.

Also, in the driver club head according to the embodiment of the present invention, loft is preferably 13 to 20 degrees.

The degree of loft less than 13 degrees has difficulty in achieving a ball launch angle of 13 degrees or more immediately after ball impact. As a result, it becomes difficult to impact a golf ball within the above-mentioned elliptic regions. On the other hand, the degree of loft more than 20 degrees decreases the restitution ratio, or the ratio of initial ball velocity relative to club head speed, thereby decreasing the ball speed. As a result, the golf ball carry will not be improved.

According to the present invention, a driver club head, which requires the greatest ball flight distance among wood golf club heads, is achieved that can describe the optimum trajectory of a golf ball.

The present invention is most applicable to a driver club head, but it can also be applied to other wood golf club heads.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A wood golf club head having plural structural parameters including a first structural parameter having a first value and a second structural parameter having a second value respectively selected in combination with one another so that said club head is thereby adapted to strike and launch a golf ball with a launch angle and a backspin speed of the golf ball within respective interrelated ranges defined by a region bounded by a first ellipse in a coordinate system having horizontal coordinates on a horizontal axis designating the launch angle and vertical coordinates on a vertical axis designating the backspin speed, wherein said horizontal coordinates and said vertical coordinates both have the same numerical scale and spacing, and wherein said first ellipse has a first centerpoint at a first said horizontal coordinate of 21 degrees and a first said vertical coordinate of 1800 rpm, a first major axis with a length equal to 2100 rpm, a first minor axis with a length equal to 5.7 degrees, and a first tilt angle of 0.25 degrees of said first major axis tilted counterclockwise relative to said vertical axis.

2. The wood golf club head according to claim 1, wherein the launch angle is at least 19° and the backspin speed is not more than 3000 rpm.

3. The wood golf club head according to claim 1, wherein the region is more narrowly bounded by a second ellipse within said first ellipse, wherein said second ellipse has a second centerpoint at a second said horizontal coordinate of 23 degrees and a second said vertical coordinate of 1700 rpm, a second major axis with a length equal to 1900 rpm, a second minor axis with a length equal to 3.9 degrees, and a second tilt angle of 0.19 degrees of said second major axis tilted counterclockwise relative to said vertical axis.

4. The wood golf club head according to claim 3, wherein the region is more narrowly bounded by a third ellipse within said second ellipse, wherein said third ellipse has a third centerpoint at a third said horizontal coordinate of 23 degrees and a third said vertical coordinate of 1700 rpm, a third major axis with a length equal to 1400 rpm, a third minor axis with a length equal to 2.8 degrees, and a third tilt angle of 0.19 degrees of said third major axis tilted counterclockwise relative to said vertical axis.

5. The wood golf club head according to claim 1, wherein the ellipse is determined by solving the equation of motion according to the following equations:

$$F_X(t)=-\tfrac{1}{2}(C_D(t)\cos\alpha+C_L(t)\sin\alpha)\,\rho A V_B(t)^2$$

$$F_Y(t)=-\tfrac{1}{2}(C_D(t)\sin\alpha-C_L(t)\cos\alpha)\,\rho A V_B(t)^2-\mathrm{mg}$$

$$N(t+\Delta t)=-\rho A d C_m(t) V_B(t)^2 \Delta t/(4\pi I)+N(t)$$

wherein $F_X(t)$ is force applied to the ball in flight in a flight direction thereof at time instant t, $F_Y(t)$ is force applied to the ball in flight in a vertical direction at time instant t, and $N(t+\Delta t)$ is decrease in a rotational speed of the ball due to aerodynamic torque after time interval of $\Delta t$; and wherein $C_D$: drag coefficient, $C_L$: lift coefficient, $\alpha$: elevation angle of the ball(deg), $\rho$: air density(kg/m$^3$), A: ball sectional area(m$^2$) of the ball, $V_B$: ball velocity(m/sec) of the ball, m: ball mass(kg) of the ball, g: gravitational acceleration(m/sec$^2$), $C_m$: moment coefficient, d: ball diameter(m) of the ball, I: moment of inertia of the ball (kg·m$^2$), N: ball rotational speed(rps) of the ball.

6. The wood golf club head according to claim 1, having a striking surface adapted to strike the ball, wherein said striking surface is formed of a low friction material.

7. The wood golf club head according to claim 6, wherein said low friction material comprises a coating of diamond-like carbon (DLC), ceramic, or SiC applied on a club head body of said golf club head.

8. The wood golf club head according to claim 6, wherein said low friction material consists of DYNEEMA® FRP.

9. The wood golf club head according to claim 6, wherein said low friction material comprises a plating layer of chromium or dispersed nickel plated on a club head body of said golf club head.

10. The wood golf club head according to claim 6, wherein said low friction material comprises an insert of polyacetal, polyamide, polytetrafluoroethylene, polyphenylenesulfide, polyamideimide, or polyimide inserted into a club head body of said golf club head.

11. The wood golf club head according to claim 1, having a striking face adapted to strike the ball, wherein said striking face is formed of a composite material made from pitch-based carbon fibers and a pitch-based matrix.

12. The wood golf club head according to claim 1, being a driver club head.

13. The wood golf club head according to claim 12, having a striking face adapted to strike the ball, wherein said first structural parameter is a loft angle of said striking face, and said first value of said loft angle is in a range from 13 to 20 degrees.

14. The wood golf club head according to claim 13, wherein said first value of said loft angle is greater than 13 degrees.

15. The wood golf club head according to claim 14, wherein said second structural parameter is a coefficient of friction of said striking face, and said second value of said coefficient of friction is not more than 0.1.

16. A wood golf club head having a striking face adapted to strike and launch a golf ball, wherein:

said striking face has a coefficient of friction and a loft angle selected in combination with one another so that said club head is thereby adapted to launch the golf ball with a launch angle and a backspin speed of the golf ball within an angle-speed region bounded by an ellipse in a coordinate system having first coordinates on a first axis designating the launch angle and second coordinates on a second axis designating the backspin speed, said ellipse has a centerpoint at coordinates of 21 degrees and 1800 rpm, a major axis intersecting said ellipse at coordinates of 16.42 degrees and 2849.99 rpm and at coordinates of 25.58 degrees and 750.01 rpm, and a minor axis intersecting said ellipse at coordinates of 18.15 degrees and 1799.99 rpm arid at coordinates of 23.85 degrees and 1800.01 rpm, said launch angle is at least 19 degrees, said backspin speed is not more than 3000 rpm; and said loft angle is greater than 13°.

17. A method of designing a wood golf club head comprising the steps:

a) defining interrelated ranges of a launch angle and a backspin speed of a golf ball in an angle-speed region bounded by an ellipse in a coordinate system having horizontal coordinates on a horizontal axis designating the launch angle and vertical coordinates on a vertical axis designating the backspin speed, wherein said horizontal coordinates and said vertical coordinates both have the same numerical scale and spacing, and wherein said ellipse has a centerpoint at said horizontal coordinate of 21 degrees and said vertical coordinate of 1800 rpm, a major axis with a length equal to 2100 rpm, a minor axis with a length equal to 5.7 degrees, and a tilt angle of 0.25 degrees of said major axis tilted counterclockwise relative to said vertical axis;

b) testing golf club heads having various coefficients of friction and loft angles of respective striking faces thereof adapted to strike the golf ball, to determine a correlation of said loft angles and said coefficients of friction relative to said launch angle and said backspin speed;

c) selecting, in combination with one another, a selected coefficient of friction and a selected loft angle for a striking face of a particular golf club head adapted to strike the golf ball, such that the golf ball when struck and launched by said particular golf club head, will have said launch angle and said backspin speed falling within said ellipse; and d) designing said particular golf club head to have said selected coefficient of friction and said selected loft angle.

* * * * *

UNITED STATES PATENT AND TRADEMARK OFFICE

CERTIFICATE OF CORRECTION

PATENT NO. : 6,939,248 B2
DATED : September 6, 2005
INVENTOR(S) : Naruo et al.

It is certified that error appears in the above-identified patent and that said Letters Patent is hereby corrected as shown below:

Column 4,
Line 33, after "ball(deg)," replace "π:" by -- ρ: --.

Column 10,
Line 66, after "rpm" replace "arid" by -- and --.

Column 11,
Line 2, after "3000" replace "rpm;" by -- rpm, --.

Signed and Sealed this

Seventeenth Day of January, 2006

JON W. DUDAS
*Director of the United States Patent and Trademark Office*